US009441444B2

(12) United States Patent
Ward et al.

(10) Patent No.: US 9,441,444 B2
(45) Date of Patent: Sep. 13, 2016

(54) MODULAR SUBSEA STRIPPER PACKER AND METHOD OF USING SAME

(71) Applicant: National Oilwell Varco, L.P., Houston, TX (US)

(72) Inventors: Richard Michael Ward, Conroe, TX (US); James Allen Douty, The Woodlands, TX (US); Jeffrey Jeffrey Melancon, Willis, TX (US); Douglas Avery Ware, New Waverly, TX (US)

(73) Assignee: National Oilwell Varco, L.P., Houston, TX (US)

( * ) Notice: Subject to any disclaimer, the term of this patent is extended or adjusted under 35 U.S.C. 154(b) by 344 days.

(21) Appl. No.: 14/026,782

(22) Filed: Sep. 13, 2013

(65) Prior Publication Data

US 2015/0075801 A1 Mar. 19, 2015

(51) Int. Cl.
*E21B 33/068* (2006.01)
*E21B 33/076* (2006.01)

(52) U.S. Cl.
CPC ..... *E21B 33/076* (2013.01); *E21B 33/068* (2013.01)

(58) Field of Classification Search
CPC ..... E21B 17/01; E21B 17/07; E21B 17/085; E21B 33/068; E21B 33/076
USPC ..... 166/345, 349, 367, 368
See application file for complete search history.

(56) References Cited

U.S. PATENT DOCUMENTS 1,895,132 A * 1/1933 Minor ..... E21B 19/00 166/77.4
1,997,152 A 4/1935 Penick et al.
RE25,680 E * 11/1964 Brown ..... E21B 19/00 254/29 R
3,463,226 A 8/1969 Johnson
3,561,723 A 2/1971 Cugini
3,583,480 A 6/1971 Regan
3,662,823 A 5/1972 Murman et al.
3,717,000 A 2/1973 Rothwell, Jr.
3,741,295 A 6/1973 Murman et al.
3,741,296 A 6/1973 Murman et al.
4,003,430 A 1/1977 Carnahan
4,133,342 A 1/1979 Carnahan (Continued)

FOREIGN PATENT DOCUMENTS

EP 1061231 12/2000

OTHER PUBLICATIONS

Texas Oil Tools, "4.06 10/15K DSW4/DSW6 2 Door Stripper Packer", Series D Tech Unit D60100258-001/01, National Oilwell Varco, (Mar. 2008), 25 pages.

(Continued)

*Primary Examiner* — Matthew R Buck
(74) *Attorney, Agent, or Firm* — JL Salazer Law Firm

(57) ABSTRACT

A stripper packer for sealing a tubular of a wellsite is provided. The stripper packer includes an extendable housing, a packer, and a sliding window. The extendable housing has a passage therethrough to receive the tubular, and includes a piston operatively connectable between an upper and a lower portion of the extendable housing for selective movement therebetween. The packer is positionable within the extendable housing and sealingly engageable with the tubular. The sliding window is slidably positionable in the passage of the extendable housing and engageable with the packer. The sliding window is movable with the piston in response to pressure whereby the packer is sealable with the tubing.

27 Claims, 6 Drawing Sheets

(56) References Cited

U.S. PATENT DOCUMENTS

| | | | | |
|---|---|---|---|---|
| 4,220,206 | A | 9/1980 | Van Winkle | |
| 4,262,748 | A | 4/1981 | Kirkland | |
| 4,392,633 | A | 7/1983 | Van Winkle | |
| 4,416,441 | A | 11/1983 | Van Winkle | |
| 4,423,775 | A * | 1/1984 | Wilson | E21B 33/08 166/84.4 |
| 4,646,825 | A | 3/1987 | Van Winkle | |
| 4,648,782 | A | 3/1987 | Kraft | |
| 4,690,033 | A | 9/1987 | Van Winkle | |
| 4,690,411 | A | 9/1987 | Van Winkle | |
| 4,813,495 | A | 3/1989 | Leach | |
| 4,899,823 | A | 2/1990 | Cobb et al. | |
| 4,923,005 | A | 5/1990 | Laky et al. | |
| 4,943,031 | A | 7/1990 | Van Winkle | |
| 4,986,360 | A | 1/1991 | Laky et al. | |
| 5,505,426 | A | 4/1996 | Whitby et al. | |
| 5,515,925 | A | 5/1996 | Boychuk | |
| 5,566,753 | A | 10/1996 | Van Winkle et al. | |
| 5,735,502 | A | 4/1998 | Levett et al. | |
| 5,897,094 | A | 4/1999 | Brugman et al. | |
| 5,961,094 | A | 10/1999 | Van Winkle | |
| 5,975,484 | A | 11/1999 | Brugman et al. | |
| 6,006,647 | A | 12/1999 | Van Winkle | |
| 6,012,528 | A | 1/2000 | Van Winkle | |
| 6,113,061 | A | 9/2000 | Van Winkle | |
| 6,164,619 | A | 12/2000 | Van Winkle et al. | |
| 6,230,824 | B1 | 5/2001 | Peterman et al. | |
| 6,244,560 | B1 | 6/2001 | Johnson | |
| 6,321,846 | B1 | 11/2001 | Rytlewski | |
| 6,364,021 | B1 | 4/2002 | Coats | |
| 6,439,302 | B1 * | 8/2002 | Wiedemann | E21B 33/068 166/84.4 |
| 6,457,526 | B1 | 10/2002 | Dailey | |
| 6,484,808 | B2 * | 11/2002 | Jones | E21B 33/08 166/379 |
| 6,742,597 | B2 | 6/2004 | Van Winkle et al. | |
| 6,857,534 | B1 | 2/2005 | Keller | |
| 7,096,960 | B2 | 8/2006 | Hemphill et al. | |
| 7,114,571 | B2 | 10/2006 | Gatherar et al. | |
| 7,165,619 | B2 | 1/2007 | Fox et al. | |
| 7,181,808 | B1 | 2/2007 | Van Winkle | |
| 7,207,384 | B2 | 4/2007 | Dallas et al. | |
| 7,431,092 | B2 | 10/2008 | Haheim et al. | |
| 7,523,644 | B2 | 4/2009 | Van Winkle | |
| 8,387,701 | B2 | 3/2013 | Sbordone | |
| 8,522,864 | B1 * | 9/2013 | Miller | E21B 33/085 166/368 |
| 2002/0074131 | A1 | 6/2002 | Jones et al. | |
| 2003/0079881 | A1 | 5/2003 | Moss | |
| 2004/0124380 | A1 | 7/2004 | Van Winkle | |
| 2005/0061499 | A1 | 3/2005 | Hopper | |
| 2005/0077043 | A1 | 4/2005 | Dallas | |
| 2005/0279494 | A1 | 12/2005 | Sachdeva et al. | |
| 2006/0076526 | A1 | 4/2006 | McWhorter et al. | |
| 2007/0051164 | A1 | 3/2007 | Van Winkle | |
| 2008/0121429 | A1 | 5/2008 | Bamford | |
| 2008/0185152 | A1 | 8/2008 | Sbordone et al. | |
| 2008/0185153 | A1 | 8/2008 | Smedstad et al. | |
| 2008/0277122 | A1 | 11/2008 | Tinnen | |
| 2008/0302530 | A1 * | 12/2008 | Shampine | E21B 33/068 166/250.08 |
| 2009/0050329 | A1 | 2/2009 | Johnson et al. | |
| 2009/0152817 | A1 | 6/2009 | Du | |
| 2010/0270746 | A1 * | 10/2010 | Van Winkle | E21B 33/076 277/322 |
| 2011/0315404 | A1 | 12/2011 | Bailey et al. | |
| 2012/0125622 | A1 | 5/2012 | Melancon et al. | |
| 2013/0192847 | A1 | 8/2013 | Bailey et al. | |

OTHER PUBLICATIONS

Dictionary definition of "about", accessed on Nov. 20, 2013 via thefreedictionary.com.

Dictionary definition of "door", accessed on Jul. 18, 2013 via thefreedictionary.com.

Extended European Search Report for Patent Application No. 10160935.2 dated Aug. 27, 2013, 8 pages.

International Preliminary Report on Patentability for International Patent Application No. PCT/US2011/038584 dated Jan. 4, 2012.

PCT Search Report for International Application No. PCT/US2010/038584 dated Feb. 7, 2011.

Schlumberger Oilfield Glossary entry for "stripping", accessed Feb. 8, 2013 via www.glossary.slb.com.

* cited by examiner

MODULAR SUBSEA STRIPPER PACKER AND METHOD OF USING SAME

BACKGROUND

This present disclosure relates generally to activation devices used in wellsite operations. More specifically, the present disclosure relates to subsea tubulars and related equipment, such as stripper packers.

Oilfield operations may be performed to locate and gather valuable downhole fluids. Oil rigs are positioned at offshore platforms, and subsea equipment may be deployed from the platforms to subsea locations for performing the oilfield operations. Subsea equipment, such as a blowout preventer and a wellhead, may be positioned about the sea floor to seal a wellbore.

A riser and other tubing may be extended from a platform to the wellbore. Equipment, such as coiled tubing, may be deployed from the platform, through the riser, and to the wellbore to perform subsea operations. The riser may be provided with sealing devices, such as a packer, to seal with the coiled tubing. Examples of packers are provided in U.S. Pat. No. 6,484,808 and Application 2010/0270746.

SUMMARY

In at least one aspect the disclosure relates to a stripper packer for sealing a tubular of a wellsite. The stripper packer includes an extendable housing, a packer, and a sliding window. The extendable housing has a passage therethrough to receive the tubular, and includes a piston operatively connectable between an upper and a lower portion of the housing for selective movement therebetween. The packer is positionable within the extendable housing and sealingly engageable with the tubular. The sliding window is slidably positionable in the passage of the extendable housing and engageable with the packer, and is movable with the piston in response to pressure whereby the packer is sealable with the tubing.

The sliding window may have a constant inner diameter to provide pressure balancing therealong. A position of the piston may be detectable, for example, by a remotely operated vehicle, a diver, a camera, and/or a sensor. The stripper packer may also include at least one sensor. The extendable housing may have an intermediate portion between the upper and the lower portion. The intermediate portion may include a cylinder operatively connectable to the upper portion and the piston operatively connectable to the lower portion. The upper portion may include an end connectable to a first portion of the tubular. The upper portion may be connectable to the lower portion of an adjacent stripper packer. The lower portion may be connectable to the upper portion of an adjacent stripper packer. The extendable housing may be operatively connectable between portions of a conveyance. The stripper packer may also include at least one connector to operatively connect the extendable housing between the portions and/or a packer bushing positionable in the passage. The packer bushing may have an inner surface to receivably engage the packer. An end of the sliding window may be receivable in the packer bushing. The conveyance may include a riser extending from a surface platform to a wellbore. The tubing may include at least one of a coiled tubing, wireline, a slickline, a production tubing, and/or a downhole tool.

In another aspect, the disclosure relates to a stripper packer assembly for sealing a tubular of a wellsite, the tubular deployable through a conveyance. The stripper packer assembly includes at least one stripper packer and at least one connector to operatively connect the stripper packer to the conveyance. The stripper packer includes an extendable housing, a packer, and a sliding window. The extendable housing has a passage therethrough to receive the tubular, and includes a piston operatively connectable between an upper and a lower portion of the housing for selective movement therebetween. The packer is positionable within the extendable housing and sealingly engageable with the tubular. The sliding window is slidably positionable in the passage of the extendable housing and engageable with the packer, and is movable with the piston in response to pressure whereby the packer is sealable with the tubing.

The connector may be operatively connectable between the lower portion and a portion of the conveyance. The connector may be operatively connectable between the upper portion and a portion of the conveyance. The upper portion may be operatively connectable to a portion of the conveyance. The upper portion of the stripper packer may be operatively connectable to the lower portion of an adjacent stripper packer. The lower portion of the stripper packer may be operatively connectable to the upper portion of an adjacent stripper packer.

Finally, in another aspect, the disclosure relates to a method of sealing a tubular of a wellsite. The tubular is deployable through a conveyance. The method involves operatively connecting a stripper packer assembly to the conveyance and sealing the packer about the tubular. The stripper packer assembly includes at least one stripper packer and at least one connector to operatively connect the stripper packer to the conveyance. The stripper packer includes an extendable housing, a packer, and a sliding window. The extendable housing has a passage therethrough to receive the tubular, and includes a piston operatively connectable between an upper and a lower portion of the housing for selective movement therebetween. The packer is positionable within the extendable housing and sealingly engageable with the tubular. The sliding window is slidably positionable in the passage of the extendable housing and engageable with the packer, and is movable with the piston in response to pressure.

The method may also involve balancing pressure in the passage by providing the sliding window with a constant inner diameter, detecting a position of the piston, determining wear of the piston from the detecting, selectively providing the stripper packer assembly with one or more of the stripper packers, and/or varying a length of the stripper packer assembly by selectively extending the extendable housing.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

DETAILED DESCRIPTION

Figure 1:
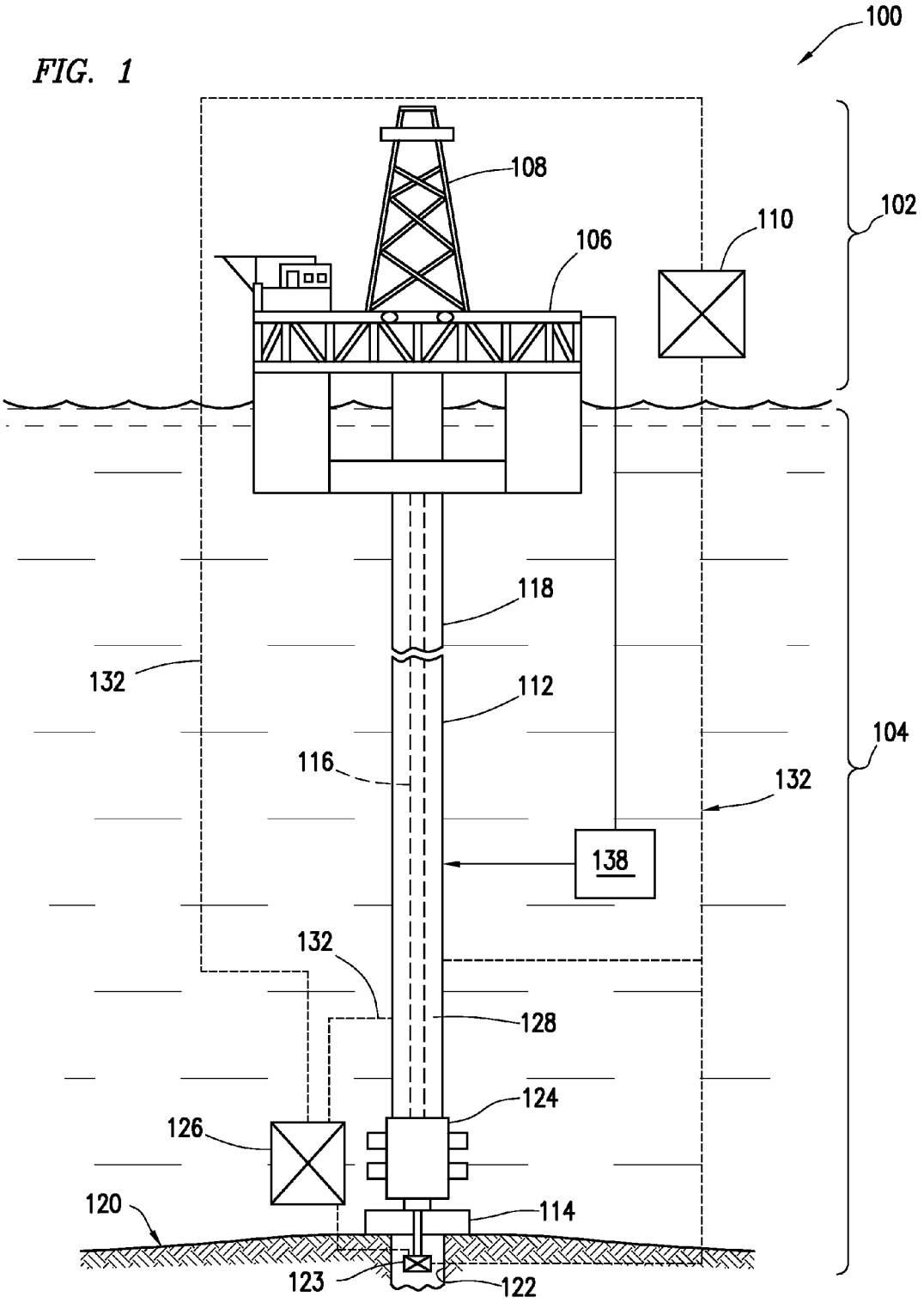
FIG. 1 is a schematic view of an offshore wellsite having a riser with a stripper packer assembly extending between a surface platform and a subsea wellbore.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the subject matter. In addition, like or identical reference numerals may be used to identify common or similar elements.

A stripper packer assembly is provided for sealing tubing, such as coiled tubing disposable through a subsea riser. The stripper packer assembly includes one or more modular stripper packers positionable along the subsea riser. The stripper packer includes a housing, a sliding window slidably positionable in the housing, pistons to extend and retract the sliding window, and a packer positioned in the housing to sealingly engage the tubing. The sleeve and the housing may define inner diameters that provide pressure balance therethrough. A position of the pistons may be detectable and used as an indicator of wear on the packer.

FIG. 1 depicts an offshore wellsite 100 in which the subject matter of the present disclosure may be used. While FIG. 1 is depicted as a subsea operation, it will be appreciated that the wellsite may be land or water based. The offshore wellsite 100 includes surface equipment 102 and subsea equipment 104 positioned at an offshore location. The surface equipment 102 includes a platform 106 with a rig 108 and a surface unit 110. Other equipment may be provided about the surface to facilitate production of hydrocarbons.

The subsea equipment 104 includes a conduit, such as a riser 112, extending from the platform 106 to a wellhead 114. A tubing (or conveyance) 116 may be disposed through the riser 112. The tubing 116 may be any suitable device for conveyance, such as a coiled tubing, a wireline, a slickline, a production tubing, and/or a downhole tool. Lines 118, such as choke & kill lines, may be disposed along the riser 112 for passing fluid and/or electrical signals.

The wellhead 114 is positioned about a sea floor 120. A wellbore 122 extends from the wellhead 114 through the sea floor 120. A downhole tool 123 is deployed from the wellhead 114 into the wellbore 122. The wellhead 114 is also connected to a low rise marine package 124 which may include for example, a blowout preventer, manifold, and/or other equipment.

The subsea equipment 104 also includes a subsea controller 126, a stripper packer assembly 128 positionable along the riser 112 for engagement with the tubing 116 passing therethrough, and a remotely operated vehicle (ROV) 130 deployed to access the stripper packer assembly 128. As shown, the stripper packer assembly 128 is operatively connected between portions of the riser 112. The stripper packer assembly 128 may be used to form a seal about the tubing 116 and/or to prevent fluid from passing between the wellbore 122 and the tubing 116. In the example shown, the tubing 116 may be coiled tubing with a coiled tubing injector therealong. The coiled tubing injector may inject and/or motivate the coiled tubing and/or downhole tool 123 into the wellbore 122 through the subsea equipment 104. The stripper packer assembly 128 may be inspected and/or activated (manual or automatic) using the ROV or other deployable means, such as a diver and/or camera.

The stripper packer assembly 128 may be in communication with the surface and/or subsea units 110, 126. The surface and subsea units 110, 126 may be operatively connectable to portions of the surface and/or subsea equipment 102, 104, such as the stripper packer assembly 128 for communication therewith as schematically depicted. The surface and subsea equipment 102, 104 may communicate with the surface and downhole units 110, 126 via one or more communication links 132. The communication links 132 may be any suitable communication means, such as hydraulic lines, pneumatic lines, wiring, fiber optics, telemetry, acoustic device, and/or wireless communication.

The surface and susbea units 110, 126 may be positioned at various locations for performing desired operations. The surface and subsea units 110, 126 may include various components, such as central processing units (CPUs), controllers, communication devices, memory and other devices, useful for communicating, processing, and/or analyzing for example, data, power, and/or control signals therebetween. The surface and/or subsea units 110, 126 may be used to receive data, analyze data, and/or to selectively activate the surface and/or subsea equipment 102, 104. The stripper packer assembly 128 may be configured for automatic operation using the surface and/or subsea units 110, 126.

Figure 2:
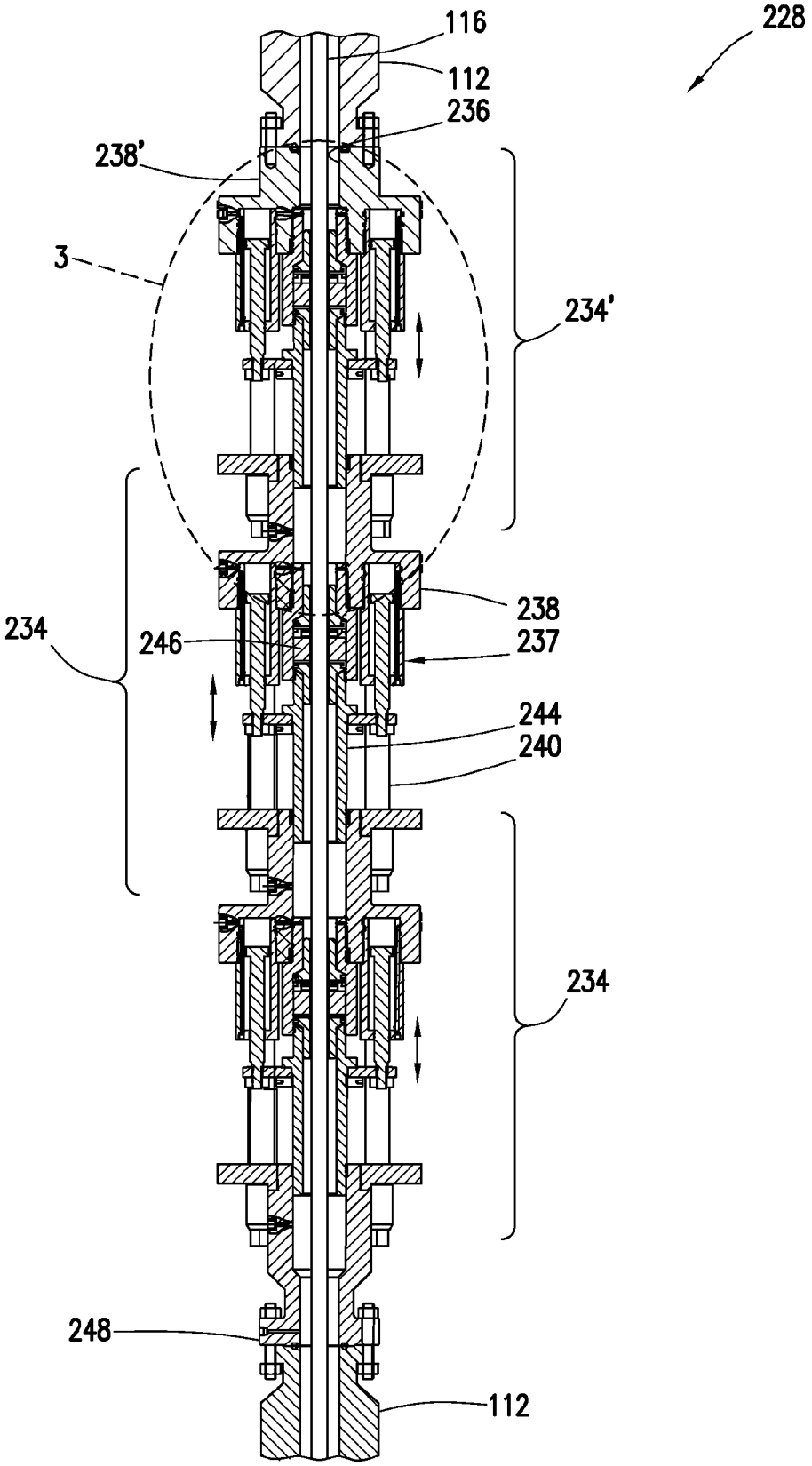
FIG. 2 is a schematic cross-sectional view of a stripper packer assembly.

FIG. 2 is a longitudinal cross-sectional view of a stripper packer assembly 228 usable as the stripper packer assembly 128 of FIG. 1. The stripper packer assembly 228 is operatively connected at each end to portions of the riser 112. As shown in this view, the stripper packer assembly 228 may be modular to include one or more stripper packers 234 as needed. The stripper packers 234 are stacked and form a passage 236 for receiving the tubing 116 therethrough.

The stripper packers 234 each include a slidable housing 237, a sliding window 244, and a packer 246. The slidable housing 237 includes an upper body 238, a lower body 240, and a slidable intermediary body 242. A modified stripper packer 234' at one end of the stripper packer assembly 228 may have a modified upper body 238' for connection to the riser 112. The stripper packer assembly 228 may be provided with a riser connector 248 for operatively connecting at least one end of the packer assembly 228 to the riser 112.

The upper body 238 of the stripper packer 234 may be disposable into the lower body 240 of an adjacent stripper packer 234. Any number of stripper packers 234, 234' may be interlockingly connected as desired to provide the desired configuration. The lower body 240 of the stripper packer 234 may have an opening to receive the upper body 238 of the adjacent stripper packer 234. The intermediate body 242 may be selectively extendable and retractable to vary a length of the stripper packer 234 and thereby the stripper packer assembly 228. The stripper packer 234, 234' and the stripper packer assembly 228 may be selectively extendable and retractable to provide various lengths for sealing about the tubing 116 as needed.

The sliding window 244 is positioned in the stripper packer assembly 238, 238' for sealing engagement with the tubular 116. The sliding window 244 is slidably positionable in the stripper packer for selective engagement with the packer 246. The sliding window 244 may be selectively movable to selectively support, compress, and/or expand the packer 246 as needed.

Figure 3:
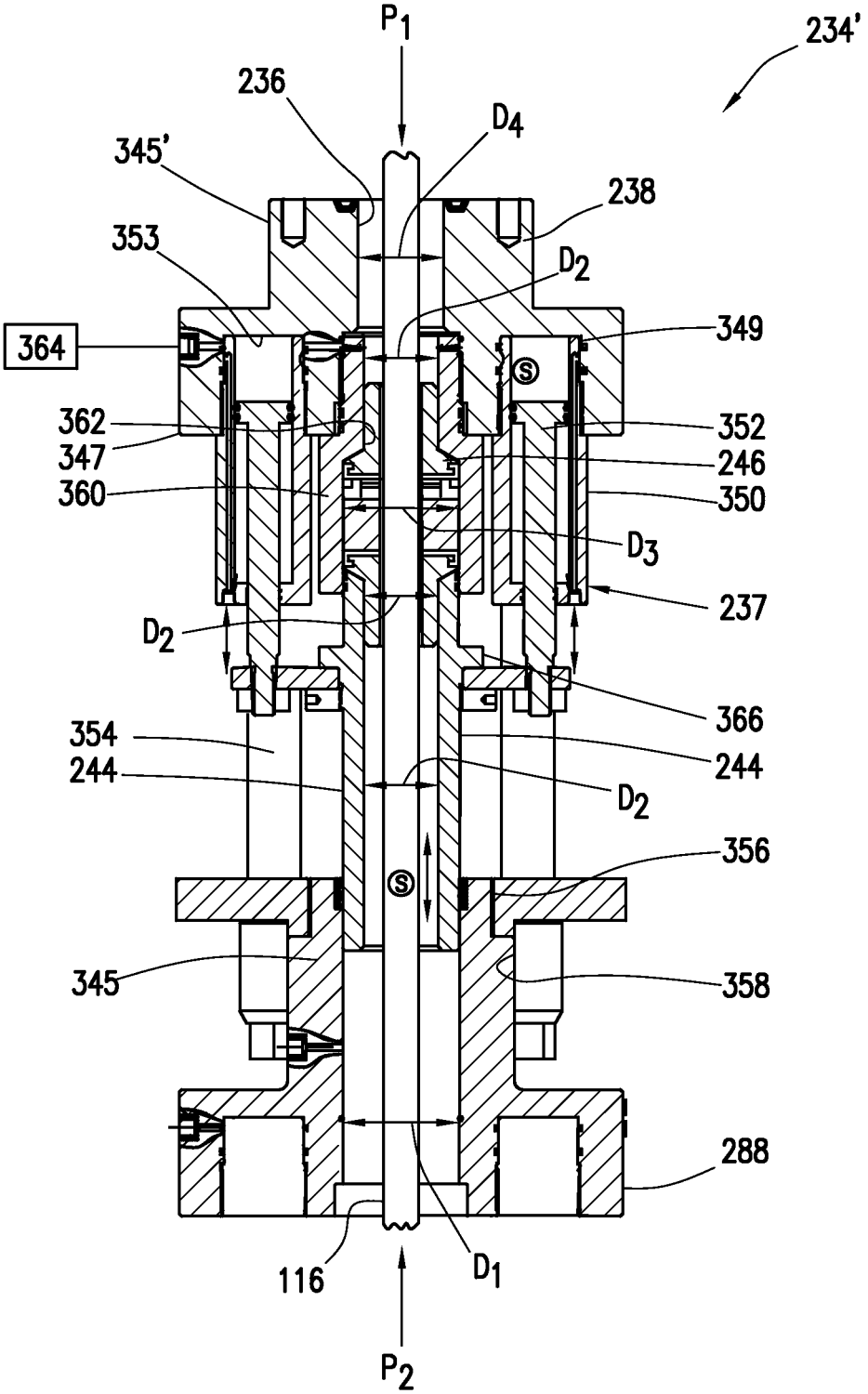
FIG. 3 is another schematic cross-sectional view of a portion 3 of the stripper packer assembly of FIG. 2.

FIG. 3 shows the stripper packer 234' in greater detail. As shown in this view, the stripper packer 234' is connected to the upper body 238 of an adjacent stripper packer 234. The stripper packer 234' includes upper body 238', and has an upper end 345' connectable to the riser 112 and a lower end 347 to receive an upper end 349 of the intermediate body 242. The intermediate body 237 includes cylinders 350 and pistons 352 at the upper end thereof. The cylinders 350 are receivable in a cavity 353 of the lower end 347 of the upper body 238'.

The pistons 352 of the intermediate body 237 are operatively connected to the lower body 240. The lower body 240 includes a tubular portion 354 operatively connecting the pistons 352 and a flange 356 operatively connectable to the upper body 238 of the adjacent stripper packer 234. The tubular portion 354 has an inner surface 358 to receivingly engage the upper end 345 of the stripper packer 234.

The stripper packer 234 is similar to the modified stripper packer 234' and has the upper end 345 configured for receipt into the inner surface 358 of the tubular portion 354 of the lower body 240. Optionally, the upper end 345 of the stripper packer 238 may be replaced with the riser connector 248 (FIG. 2) for connection with the riser 112.

The stripper packer 238' may be provided with a packer bushing 340 to receivingly engage the packer 246. The packer bushing 340 may be operatively (e.g., threadedly) connected to the upper body 238'. The packer bushing 340 has a passage 362 therethrough in fluid communication with the passage 236. The packer 246 is movably positionable in the passage 362. The packer 246 may be replaceable due to, for example, wear.

The sliding window 244 is slidably supported in the lower body 240. The sliding window 244 extends from one stripper packer 238 into an adjacent stripper packer 238. The sliding window 244 extends from the packer bushing 340, through the tubular portion 354 of the lower body 240, and into the upper end 345 of the upper body 238 of the adjacent stripper packer 238'. The sliding window 244 is slidably positionable for selective engagement with the packer 246. The sliding window 244 may be advanced against the packer 246 for compression thereof, or retracted from the packer 246 for expansion or removal thereof.

The sliding window 244 may be activated by movement of the intermediate body 242 in response to forces applied thereto and/or by activation (e.g., using surface or downhole units 110, 126 of FIG. 1). The intermediate body 242 is slidably movable by extension and retraction of the pistons 352 about the cylinders 350. A fluid source 364 may be provided to selectively apply fluid pressure into cavity 353 to drive the pistons 352 as schematically depicted. One or more pistons 352 and corresponding cylinders 350 may be provided.

The sliding window 244 has a shoulder 366 positionable adjacent to the tubular portion 354 and movable therewith. The pistons 352 are operatively connectable to the tubular portion 354 and also movable therewith. Thus, retraction of the pistons 352 moves the tubular portion 354 and the sleeve 244 adjacent thereto.

The stripper packers 238, 238' have inner diameters D1-D4 therein defining the passage 236 therethrough. The inner diameters D1-D4 may have varied dimensions. As shown, the upper end 345 of the stripper packer 238 has the inner diameter D1. A connecting portion of the packer bushing 340 and the sliding window 244 have the inner diameter D2. A packer portion of the packer bushing 340 has the inner diameter D3 to receive the packer 246. The upper end 345 of the stripper packer 238' has the inner diameter D4.

The inner diameters D1-D4 may be selected for pressures P1,P2 applied through the stripper packers 238, 238' as indicated by the arrows. In some cases, the inner diameters D1-D4 may be selected to be approximately the same or within a given range such that pressure is balanced through the stripper packer assembly. For example, the sliding window 244 may have a constant inner diameter D2 therealong for pressure balancing. Pressure is equalized (P1=P2) across the sliding window 244 when the packer is not energized. When the packer is energized, pressure is not equalized (P1≠P2) across the sliding window 244.

During operation, the packer 246 may wear over time. As the packer 246 wears, the packer 246 may compress further. As the packer 246 compresses, less force from the packer 246 will press against the sliding window 244 thereby permitting the piston 352 to travel closer to the retracted position into the cavity 353. The position of the piston 352 may be monitored to determine changes over time. As the piston 352 begins to extend further into the cylinder 350 over time, it may be determined that the packer 246 needs to be replaced.

The piston 352 may be monitored visually, manually, automatically or otherwise. For example, the piston 352 may be viewed by deployable means, such as ROVs, cameras, and divers, deployed about the stripper packer assembly 228. Sensors S, such as proximity switches or position detectors, may also be provided about the pistons 352 to monitor the piston 352. The sensors S also may be provided about the stripper packer assembly 228 as schematically shown to measure a variety of subsea parameters, such as downhole pressures, temperatures and other parameters. The sensors S may be coupled to the surface and/or downhole units 110, 126 for communicating therewith. Data collected by the sensors S may be used, for example, to provide alerts, send data, etc. The stripper packer 234, 234' may be provided with other features, such as seals, connectors, vents, and other devices to facilitate sealing about the tubing 116.

Figure 4A:
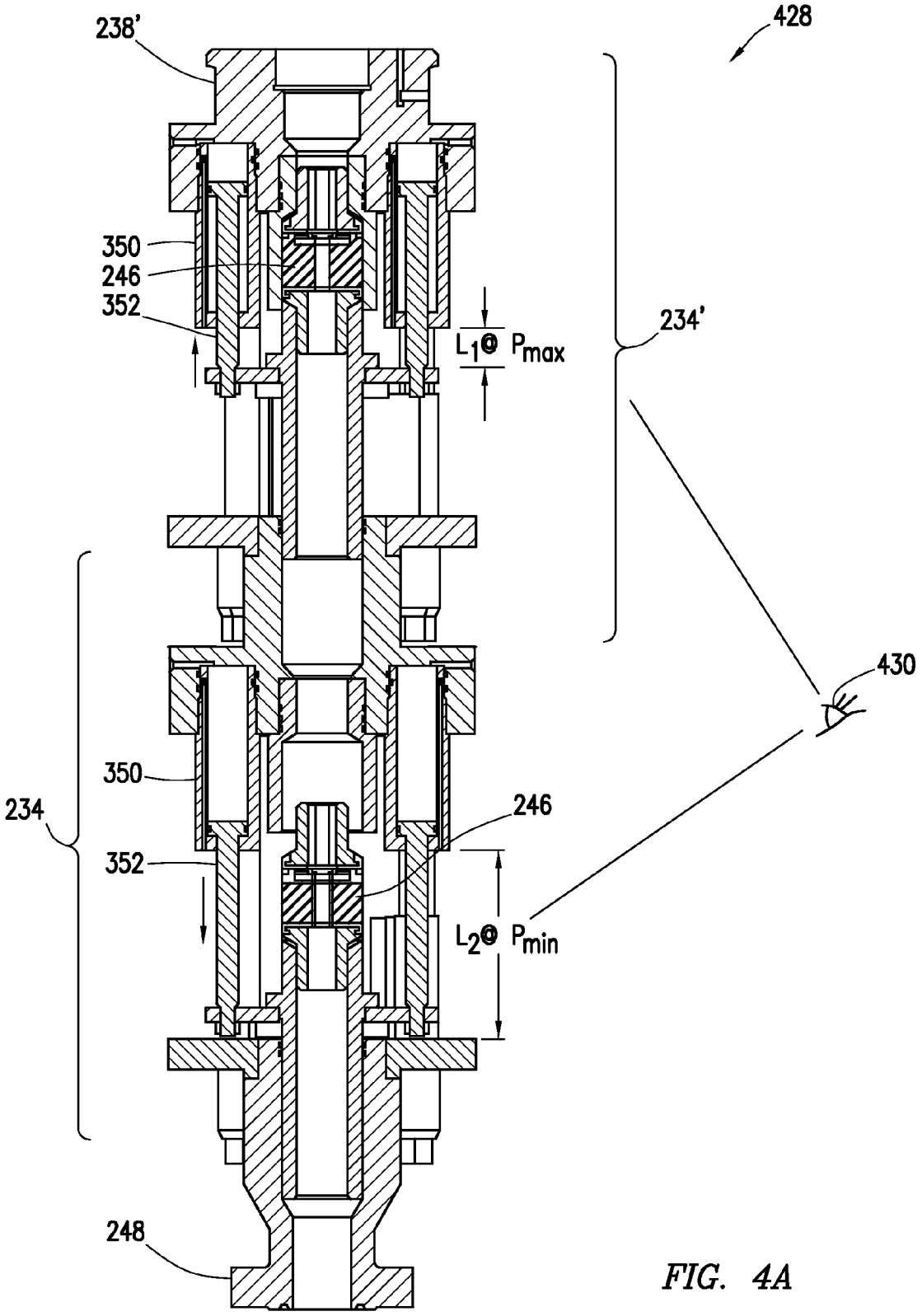
FIGS. 4A and 4B are perspective front and back cross-sectional views, respectively, of another stripper packer assembly.
Figure 4B:
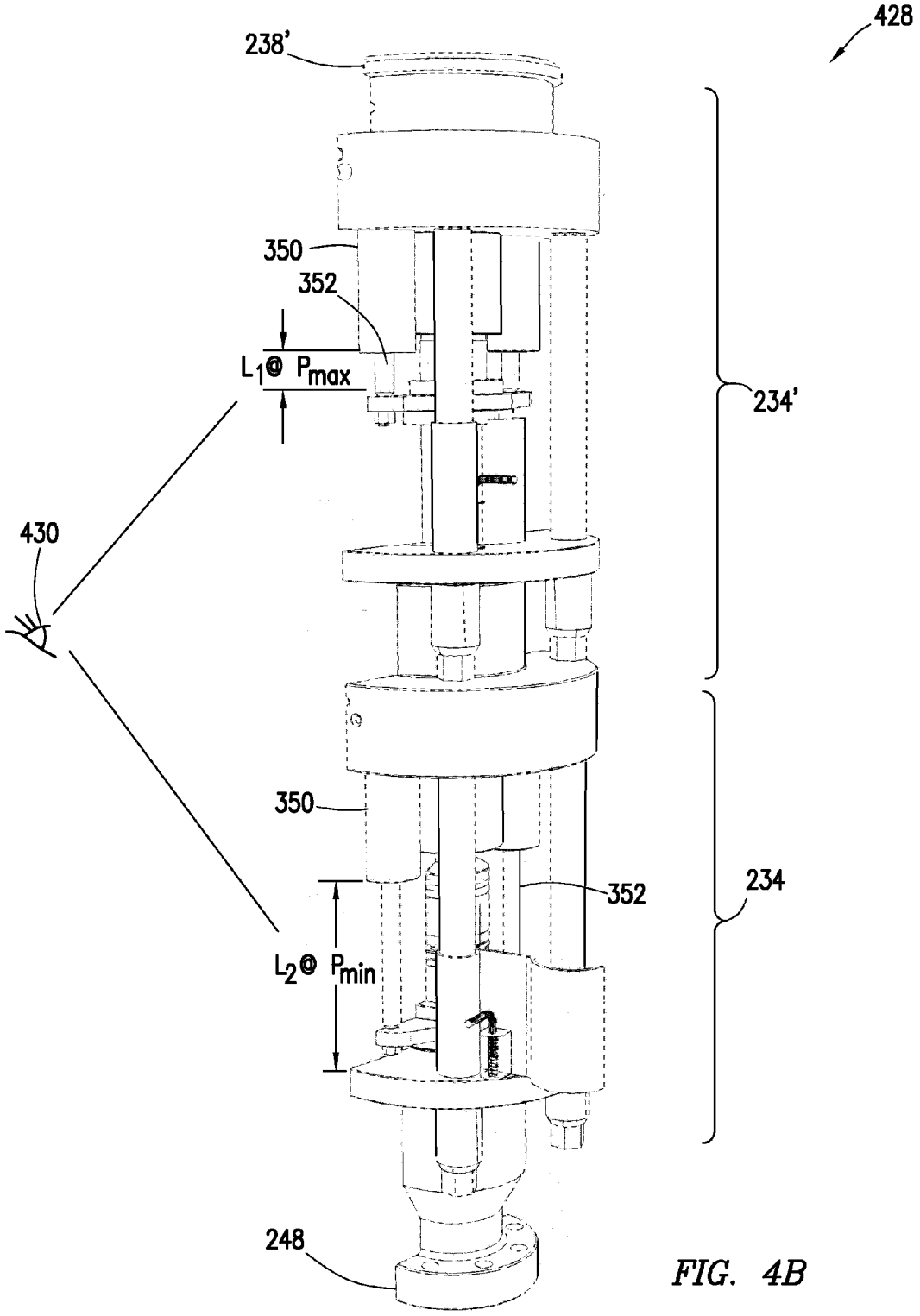

FIGS. 4A and 4B show additional cross-sectional views of a stripper packer assembly 428 from a front perspective and a back perspective. The stripper packer assembly 428 may be similar to the stripper packer assembly 228, but includes two stripper packers 234', 234 as previously described. The stripper packer 234 has the riser connector 248 at a lower end for connection to riser 112 as previously described.

As shown in the views of FIGS. 4A and 4B, the overall length of the stripper packer assembly 428 is variable by extension and retraction of one or more of the individual stripper packers 234', 234'. As depicted, the intermediate body 242 of the stripper packer 234' is partially retracted for compression of packer 246, and the intermediate body 242 of the stripper packer 234' is fully extended for retraction of the packer 246. The intermediate body 242 may be selectively extended and retracted by movement of the pistons 352 about the cylinders 350.

As shown by FIGS. 4A and 4B, the positions of the pistons 352 are detectable (e.g., visually, mechanically, hydraulically, and/or electrically). The position of the piston 352 may be determined, for example, by detecting the position of the piston 352 within the cylinder 350 or by a length L1, L2 of stroke of the piston 352. For example, an eye (e.g., camera, operator, ROV, etc.) 430 may visibly detect the lengths L1, L2 to detect wear or other potential problems. Other measureable dimensions of the piston 352 and/or other components moving therewith, such as lower body 240, packer 246, sliding window 244, may be detectable.

As also shown by FIGS. 4A and 4B, the piston 352 is movable between the retracted (or closed) position with a stroke length L1 and an extended (or open) position with a stroke length L2. In the retracted position, L1 is reduced and pressure in the piston 352 increases toward Pmax. In the extended position, L2 increases and pressure in the piston 352 decreases toward Pmin. The movement of the piston towards the L1, Pmax piston may be measured over time to know when to energize another packer to maintain a proper seal with the tubing 116.

Figure 5:
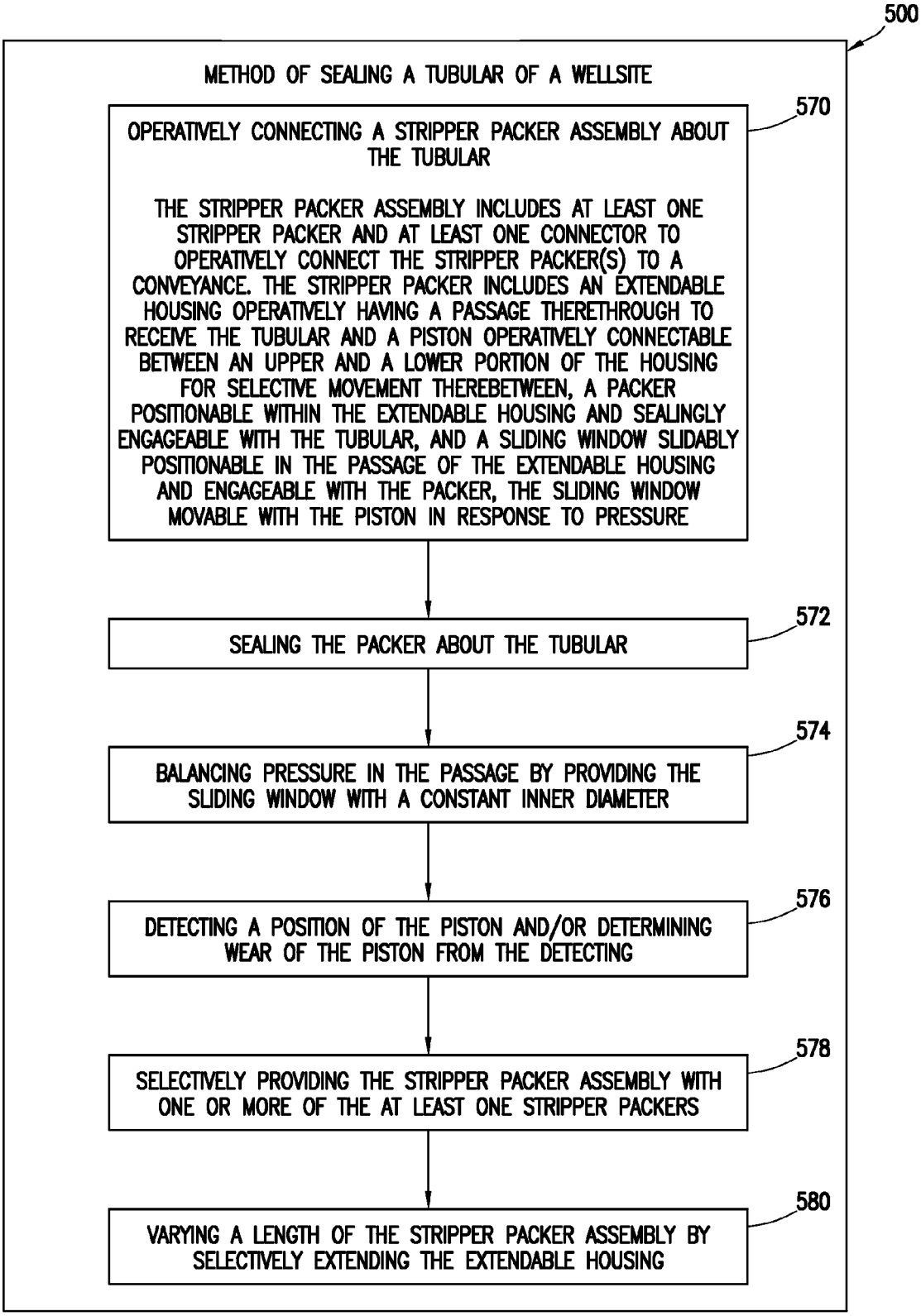
FIG. 5 is a flowchart depicting a method of sealing a tubular of a wellbore.

FIG. 5 shows a method 500 of sealing a tubular of a wellsite. The method 500 involves 570—operatively connecting a stripper packer assembly about the tubular. The stripper packer assembly includes at least one stripper packer and at least one connector to operatively connect the stripper packer(s) to the conveyance. The stripper packer includes an extendable housing operatively having a passage therethrough to receive the tubular and a piston operatively connectable between an upper and a lower portion of the housing for selective movement therebetween, a packer positionable within the extendable housing and sealingly engageable with the tubular, and a sliding window slidably positionable in the passage of the extendable housing and engageable with the packer, the sliding window movable with the piston in response to pressure. The method further involves 572—sealing the packer about the tubular.

The method may also involve 574—balancing pressure in the passage by providing the sliding window with a constant inner diameter, 576—detecting a position of the piston and/or determining wear of the piston from the detecting, 578—selectively providing the stripper packer assembly with one or more of the at least one stripper packers, and/or 580—varying a length of the stripper packer assembly by selectively extending the extendable housing.

The method may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more stripper packers and/or stripper packer assembly, units, sensors, pistons, packers, sleeves, seals, and other components may optionally be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A stripper packer for sealing a tubular of a wellsite, the stripper packer comprising:

an extendable housing having a passage therethrough to receive the tubular, the extendable housing comprising a piston operatively connectable between an upper and a lower portion of the extendable housing for selective movement therebetween to selectively extend and retract the upper portion relative to the lower portion;

a packer positionable within the extendable housing and sealingly engageable with the tubular; and a sliding window slidably positionable in the passage of the extendable housing and engageable with the packer, the sliding window movable with the piston in response to pressure whereby the packer is sealable with the tubular.

2. The stripper packer of claim 1, wherein the sliding window has a constant inner diameter to provide pressure balancing therealong.

3. The stripper packer of claim 1, wherein a position of the piston is detectable.

4. The stripper packer of claim 3, wherein the position of the piston is detectable by one of a remote operated vehicle, a diver, a camera, a sensor, and combinations thereof.

5. The stripper packer of claim 1, further comprising at least one sensor.

6. The stripper packer of claim 1, wherein the extendable housing has an intermediate portion between the upper and the lower portion, the intermediate portion comprising a cylinder operatively connectable to the upper portion and the piston operatively connectable to the lower portion.

7. The stripper packer of claim 1, wherein the upper portion is connectable to a conveyance.

8. The stripper packer of claim 1, wherein the upper portion is connectable to the lower portion of an adjacent stripper packer.

9. The stripper packer of claim 1, wherein the lower portion is connectable to the upper portion of an adjacent stripper packer.

10. The stripper packer of claim 1, further comprising a packer bushing positionable in the passage, the packer bushing having an inner surface to receivably engage the packer.

11. The stripper packer of claim 10, wherein an end of the sliding window is receivable in the packer bushing.

12. The stripper packer of claim 1, wherein the extendable housing is operatively connectable between portions of a conveyance.

13. The stripper packer of claim 12, further comprising at least one connector to operatively connect the extendable housing between the portions.

14. The stripper packer of claim 12, wherein the conveyance comprises a riser extending from a surface platform to a wellbore.

15. The stripper packer of claim 1, wherein the tubular comprises at least one of a coiled tubing, wireline, a slickline, a production tubing, and a downhole tool.

16. A stripper packer assembly for sealing a tubular of a wellsite, the tubular deployable through a conveyance, the stripper packer assembly comprising:

at least one stripper packer, comprising:

an extendable housing having a passage therethrough to receive the tubular, the extendable housing comprising a piston operatively connectable between an upper and a lower portion of the extendable housing for selective movement therebetween to selectively extend and retract the upper portion relative to the lower portion;

a packer positionable within the extendable housing and sealingly engageable with the tubular; and a sliding window slidably positionable in the passage of the extendable housing and engageable with the packer, the sliding window movable with the piston in response to pressure whereby the packer is sealable with the tubular; and at least one connector to operatively connect the at least one stripper packer to the conveyance.

17. The stripper packer assembly of claim 16, wherein the at least one connector is operatively connectable between the lower portion and a portion of the conveyance.

18. The stripper packer assembly of claim 16, wherein the at least one connector is operatively connectable between the upper portion and a portion of the conveyance.

19. The stripper packer assembly of claim 16, wherein the upper portion is operatively connectable to a portion of the conveyance.

20. The stripper packer assembly of claim 16, wherein the upper portion of the at least one stripper packer is operatively connectable to the lower portion of an adjacent stripper packer.

21. The stripper packer assembly of claim 16, wherein the lower portion of the at least one stripper packer is operatively connectable to the upper portion of an adjacent stripper packer.

22. A method of sealing a tubular of a wellsite, the tubular deployable through a conveyance, the method comprising:

operatively connecting a stripper packer assembly to the conveyance, the stripper packer assembly comprising:

at least one stripper packer, comprising:

an extendable housing having a passage therethrough to receive the tubular, the extendable housing comprising a piston operatively connectable between an upper and a lower portion of the extendable housing for selective movement therebetween to selectively extend and retract the upper portion relative to the lower portion;

a packer positionable within the extendable housing and sealingly engageable with the tubular; and a sliding window slidably positionable in the passage of the extendable housing and engageable with the packer, the sliding window movable with the piston in response to pressure; and at least one connector to operatively connect the at least one stripper packer to the conveyance; and sealing the packer about the tubular.

23. The method of claim 22, further comprising balancing pressure in the passage by providing the sliding window with a constant inner diameter.

24. The method of claim 22, further comprising detecting a position of the piston.

25. The method of claim 24, further comprising determining wear of the piston from the detecting.

26. The method of claim 22, further comprising selectively providing the stripper packer assembly with one or more of the at least one stripper packers.

27. The method of claim 22, further comprising varying a length of the stripper packer assembly by selectively extending the extendable housing.

* * * * *